United States Patent [19]

Kawashima

[11] 3,967,350

[45] July 6, 1976

[54] SLIDER FOR HEAVY DUTY SLIDE FASTENERS

[75] Inventor: Teruaki Kawashima, Namerikawa, Japan

[73] Assignee: Yoshida Kogyo Kabushiki Kaisha, Japan

[22] Filed: Mar. 26, 1975

[21] Appl. No.: 562,237

[30] Foreign Application Priority Data

Apr. 6, 1974 Japan ..... 49-39218[U]

[52] U.S. Cl. ..... 24/205.14 R; 24/205.11 L; 24/205.14 K

[51] Int. Cl.[2] ..... A44B 19/30; A44B 19/36

[58] Field of Search ..... 24/205.14 A, 205.14 K, 24/205.11 L

[56] References Cited

UNITED STATES PATENTS

| | | | |
|---|---|---|---|
| 1,506,286 | 8/1924 | Binns | 24/205.14 A |
| 1,585,644 | 5/1926 | Binns | 24/205.14 A |
| 2,256,680 | 9/1941 | Lemmer | 24/205.14 A |
| 2,272,681 | 2/1942 | Smith | 24/205.11 L |
| 2,310,627 | 2/1943 | Greene | 24/205.11 L |
| 3,852,851 | 12/1974 | Higuchi | 24/205.14 K |

*Primary Examiner*—Bernard A. Gelak
*Attorney, Agent, or Firm*—Bucknam and Archer

[57] ABSTRACT

A slider for heavy duty slide fasteners equipped with a pair of pull tabs pivotally connected to the upper and lower wings of the slider. At least one of the pull tabs has a locking means situated within the width of the pull tab and movable into a position close to and forward of the slider entrance end to engage a top end stop inserted within the Y-shaped guide channel in the slider. The two pull tabs are further provided with an engaging member and a socket member, respectively, both members being snap fittable with each other when the pull tabs are rotated into the locking disposition thereby preventing the locking means from being accidentally forced out of engagement with the top end stop under severe stresses exerted on and around the slider.

1 Claim, 5 Drawing Figures

SLIDER FOR HEAVY DUTY SLIDE FASTENERS

BACKGROUND OF THE INVENTION

This invention relates to sliders for slide fasteners and more particularly to a slide fastener slider of the character which is suitable for mounting on and manipulating such heavy duty slide fasteners which are applied to joints in partition members such for example as oil fences or seams in hoods for use with trains or automobiles.

The slider for the heavy duty slide fasteners just described has been required, while closing the slide fastener, to be firmly retained in locked relation with respect to a pair of fastener stringers against severe stresses exerted on or around the slider. In order to meet this requirement, the prior art slider has been provided with a locking prong secured to or formed integrally with a pull tab pivotally connected to the slider body, which locking prong is adapted to engage with fastener elements mounted on a fastener stringer in order to lock the slider against movement along the fastener stringers. A pair of pull tabs have been employed which are adapted to be releasably joined at ends to maintain the prong in locking engagement with fastener elements. However, there has been experienced a difficulty such that conventional locking prongs are liable to disengage from fastener elements when subject to severe external stresses even with the aid of joined pull tabs because the prongs are so disposed as to easily become subjected to the external stresses.

SUMMARY OF THE INVENTION

With the above difficulty in view, the principal object of the invention is to provide a slider having a locking prong which is designed to be firmly retained in locking engagement with a top end stop mounted on a fastener stringer when the slider has been brought up to the terminal end of the fastener.

Another object of the invention is to provide a slider having a pair of pull tabs which are adapted to be releasably joined to stabilize the locking engagement of the locking prong with the top end stop of the fastener stringer.

These and other objects and features of the invention will appear more clear from the following detaied description taken in conjunction with the accompanying drawing which illustrates by way of example only a preferred embodiment of the invention and in which like reference characters or numerals refer to like parts throughout several views.

DETAILED DESCRIPTION OF A PREFERRED EMBODIMENT

Figure 1:
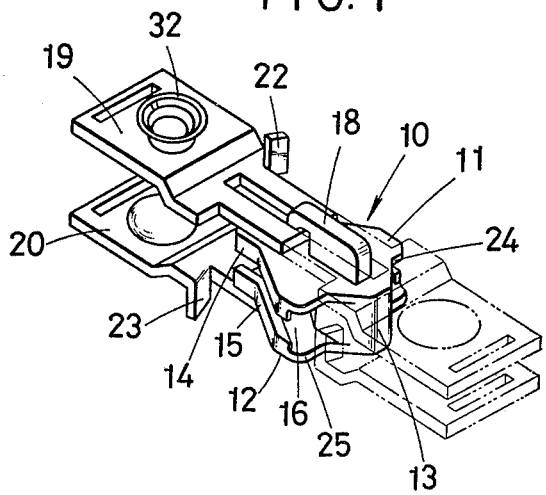
FIG. 1 is a perspective view of a slider constructed according to the invention with a pair of pull tabs in fully unlocked position.
Figure 2:
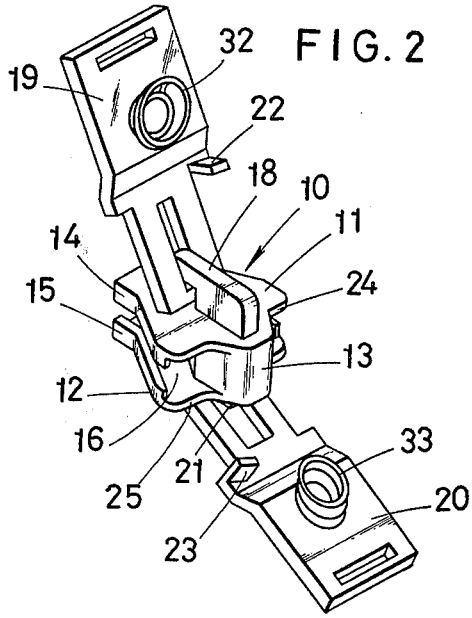
FIG. 2 is a view similar to FIG. 1, but showing the pull tabs rotated away from each other.

Referring now to the drawing and FIGS. 1 and 2 in particular, there is shown a slide fastener slider 10 which comprises an upper wing 11 and a lower wing 12 forming a slider body and connected together at one end by a neck portion 13. The upper and lower wings 11, 12 are provided with inwardly directed side flanges 14, 15, respectively, and are configured to define with the neck portion 13 a substantially Y-shaped guide channel 16 through which rows of fastener elements 17 (FIGS. 3 and 5) are allowed to pass in the well known manner. A supporting lug 18 projects upwardly from the one or upper wing 11 and is adapted to carry a pull tab 19 pivotally thereon. A similar additional pull tab 20 is also provided in accordance with the invention, which pull tab 20 is pivotally connected to another lug 21 on the other or the lower wing 12.

Figure 4:
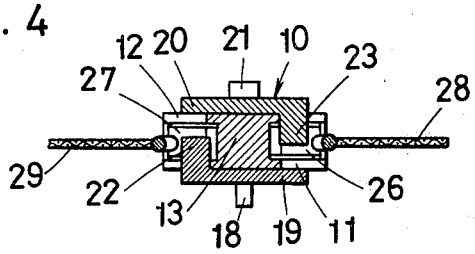
FIG. 4 is a transverse cross-sectional view of the slider taken along the line IV—IV of FIG. 3.
Figure 5:
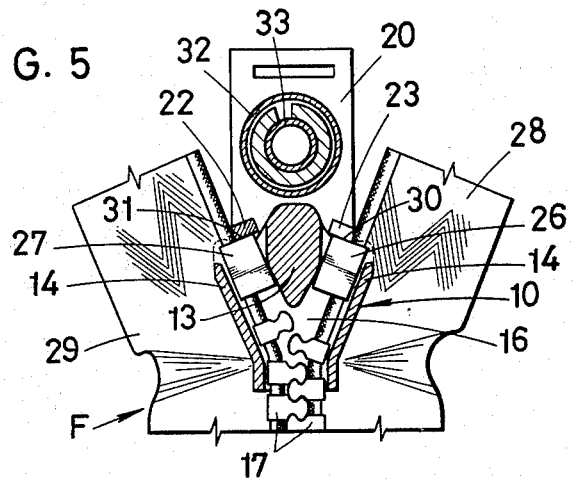
FIG. 5 is a view similar to FIG. 3, but showing the slider with its one wing and pull tab taken away to illustrate the details of its interior.

In accordance with the important features of the invention, there are provided a pair of locking prongs 22, 23 longitudinally centrally secured to or formed integrally with the pull tabs 19, 20, at their one lateral sides, respectively. The locking prongs 22, 23 are adapted to extend close to and slightly beyond the location of entrance ends 24, 25 of the slider 10 when the pull tabs 19, 20 are pivotally brought into the locking position as shown in imaginary lines of FIG. 1, whereupon the prongs 22, 23 engage with top end stops 26, 27 of the respective fastener stringers 28, 29 (FIG. 5). As seen in FIG. 5 in particular, the locking prongs 22, 23 are so inclined relative to the transverse direction of the pull tabs 19, 20 as to allow face-to-face contact with mating end surfaces 30, 31 of the respective top end stops 26, 27 to ensure secure engagement therewith when the pull tabs 19, 20 are pivoted to the locking position. An inspection of FIGS. 4 and 5 shows that the locking prongs 22, 23 extend toward the pull tabs 19, 20, respectively, but are situated within the width of the pull tabs 19, 20, so that they are protected from being subjected directly to external stresses which tend to cause the locking prongs 22, 23 to separate from the top end stops 26, 27.

In order to ensure this locking engagement of the locking prongs 22, 23, the pull tabs 19, 20 are rotated into engagement with each other and joined together beyond and forwardly of the entrance ends 24, 25 of the slider 10 when the latter has been brought to a terminal end of the slide fastener F upon closing of the latter. To thus join the pull tabs 19, 20, there is provided a socket member 32 projecting from the pull tab 19 and adapted to be forced into snap-fitting engagement with a male engaging member 33 projecting from the pull tab 20, as is well known in the art. Therefore, the twin pull tabs 19, 20 can be releasably joined together in a manner to prevent the locking prongs 22, 23 from becoming disengaged from the top ends stops 26, 27, respectively, thereby retaining the slider 10 in locked relation with the fastener stringers 28, 29.

Figure 3:
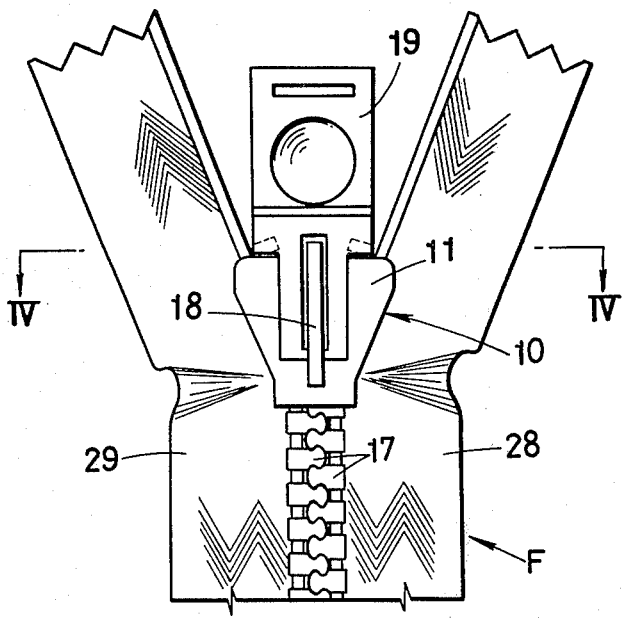
FIG. 3 is a plan view of a slide fastener equipped with the slider which is held in locked position.

Now, the operation of the slider 10 of this invention will be explained with reference to FIGS. 3, 4 and 5 wherein the slider 10 is held in locked position at the terminal end of the slide fastener F upon closing of the latter. In this position, the two pull tabs 19, 20 are joined together with the locking prongs 22, 23 engaging with the end surfaces 30, 31 of the top end stops 26, 27, respectively, which have been inserted within the Y-shaped channel 16 in the slider 10, thereby maintaining the slider 10 in locked relation with the fastener stringers 28, 29. This locked position is retained by snapping the socket 32 on the tab 19 into engagement with the male engaging member 33 on the other tab 20. When the two pull tabs 19, 20 are pivoted out of snapping engagement with each other, the locking prongs 22, 23 become disengaged from the respective top end stops 26, 27 thereby bringing the slider 10 back to fully unlocked position.

Although it has been shown for illustrative purposes that the pull tabs 19, 20 have the locking prongs 22, 23, respectively, it is to be understood that only one of the pull tabs 19, 20 may be provided with both or one of the locking prongs 22, 23.

It will be apparent that various changes and modifications may be made in the embodiment shown without departing from the scope of the appended claims.

What is claimed is:

1. In a slider for a slide fastener of the type having a pair of stringers carrying respective rows of interengageable fastener elements and end stops, the slider having upper and lower wings connected to define a generally Y-shaped guide channel having an entrance end through which the rows of fastener elements are passed, and a pair of pull tabs each pivotally connected to a corresponding one of said wings, the improvement which comprises in combination a pair of matching connector elements each on a corresponding one of said pull tabs, said connector elements being disposed for releaseable engagement to secure the pull tabs together when said pull tabs are pivoted toward each other; and a locking member projecting from each of said pull tabs, each locking member being disposed to engage a corresponding end stop when the slider is positioned to receive said end stops at the entrance end of the guide channel and the pull tabs are secured together by said connector elements.

* * * * *